United States Patent [19]

Capron et al.

[11] Patent Number: 4,942,975

[45] Date of Patent: Jul. 24, 1990

[54] CONTAINER CONNECTOR HAVING A SKEWED INSTALLATION CONFIGURATION

[75] Inventors: Mark E. Capron, Oxnard; James F. Jenkins, Ventura, both of Calif.

[73] Assignee: The United State of America as represented by the Secretary of the Navy, Washington, D.C.

[21] Appl. No.: 375,682

[22] Filed: Jul. 5, 1989

[51] Int. Cl.[5] ..... B65D 21/02

[52] U.S. Cl. ..... 220/23.4; 220/23.2; 220/1.5; 206/504; 403/297; 24/287

[58] Field of Search ..... 206/504, 509, 512; 220/1.5, 23.4, 23.2; 403/297; 24/287; 248/213.2

[56] References Cited

U.S. PATENT DOCUMENTS

| | | | |
|---|---|---|---|
| 3,294,419 | 12/1966 | Martin et al. | 220/1.5 |
| 3,294,420 | 12/1966 | Martin | 220/1.5 |
| 3,599,824 | 8/1971 | Pneuman et al. | 24/287 |
| 3,972,439 | 8/1976 | DiMartino | 24/287 |
| 3,977,800 | 8/1976 | Cassel | 403/297 |
| 4,159,592 | 7/1979 | Gabriel | 24/287 |
| 4,277,212 | 7/1981 | Rosaia | 24/287 |
| 4,440,518 | 4/1984 | Davlantes | 403/297 |
| 4,485,597 | 12/1984 | Worrallo | 403/297 |
| 4,549,832 | 10/1985 | Sterl | 403/297 |
| 4,556,337 | 12/1985 | Marshall | 403/297 |
| 4,616,951 | 10/1986 | Maatela | 403/297 |
| 4,674,910 | 6/1987 | Hayashi | 403/297 |
| 4,815,178 | 3/1989 | Klaric | 24/287 |
| 4,815,179 | 3/1989 | Klaric | 24/287 |

*Primary Examiner*—Stephen Marcus
*Assistant Examiner*—S. Castellano
*Attorney, Agent, or Firm*—David S. Kalmbaugh

[57] ABSTRACT

A container connector for interconnecting a pair of shipping containers to in essence form a single container of a larger size. There are to be utilized a plurality of these container connectors to secure together a pair of shipping containers. Each container connector comprises a grab bar and a position bar. Interconnecting the grab bar and position bar are a pair of threaded bolts. The threaded bolts are to be operable independently so that the position bar can be located at a skewed angle relative to the grab bar during installation of the container connector. Once the grab bar and the position bar are correctly installed, the bolts are rotated to cause the position bar to be moved in an outward direction from the grab bar to cause the grab bar to tightly engage with the side wall of a pair of aligned openings formed within the shipping containers which are located in a closely spaced, almost abutting, relationship.

6 Claims, 1 Drawing Sheet

CONTAINER CONNECTOR HAVING A SKEWED INSTALLATION CONFIGURATION

BACKGROUND OF THE INVENTION

The field of this invention relates to connectors and more particularly to a connector for a pair of shipping containers so that there will be in essence formed a single size container composed of the smaller container sizes.

Shipping containers that are used within ships and trucks are of a standard size with that size being of a length of almost twenty feet. All the equipment that is used in handling of the containers is designed for this size of container. This equipment has to do with the dock equipment to move the containers onto and off of the ship and when located within the cargo holds of the ship, the equipment contained within the cargo holds is designed to secure to this specific length of container. Additionally, a twenty foot length container can be readily transported by truck and the trucks are designed, again, to accommodate this specific length of container.

These containers are normally used by manufacturers or distributors of products. It is the purpose of these containers to transport the products from one country to another. The least expensive shipping price per volume of shipping space is if an entire shipping container is utilized. If a particular manufacturer or distributor does not need an entire twenty foot container but, let's say, only the volume of the equivalent to six or seven foot container, then that manufacture or distributor must pay a substantially increased fee in relation to the volume acquired.

There are shipping containers designed which are of a length smaller than the almost twenty foot length. Such shipping containers are available that are half size, a third size and some even are one-quarter size of the typical twenty foot container. However, when it comes to handling of these smaller sized containers, and placing such on and removing such from a ship and placing such on trucks, it would be far more cost effective if the smaller size containers could be securely connected together so that they could be handled as though it was a single twenty foot length container.

The ends of these smaller sized containers have been designed to include corner blocks with there being four in number of corner blocks for an end of a small size container. An end of a small size container is to be aligned in close proximity to an end of another small size container. Each of these corner blocks include openings of a specific size. Between each aligned pair of openings of a pair of corner blocks of the different shipping containers is located a connector. This connector is to be locatable in a collapsed or installing position between a pair of these aligned openings. This connector is then moved to an expanded condition which causes the connector to become tightly bound to the side walls of these openings resulting in fixedly securing the containers together into in essence a single container structure. The net result is that the connected together containers can be moved in unison into and out off the hold of a ship and onto the bed of a truck thereby eliminating the need for separate handling of the containers.

The connectors that have been utilized in the past to achieve this end result are known to have many disadvantages. One of the primary disadvantages is that they are complicated in construction and therefore expensive to manufacture and expensive to purchase. Additionally, some of these connectors require manual holding of the connector in place as it is being installed. This means that the hand of a human being is located between a pair of containers that actually weigh thousands of pounds as the containers are moved in position to be connected together. Inherently, this is a potentially dangerous situation and it is not unknown that an individual's hand has become crushed during such connecting of the containers. Additionally, some of the container connectors of the prior art do not positively lock the containers together but permit a small amount of movement between the separate containers. Even a small amount of movement is not desirable.

SUMMARY OF THE INVENTION

The container connector of the present invention utilizes a grab bar with a locking groove being formed within each end of the grab bar. One locking groove is to engage with the side wall of an opening within a corner block of one container with the other locking groove to engage with the side wall of an opening formed within the corner block of another shipping container. Between these grooves are threadably mounted within the grab bar a pair of bolts. Each of these bolts is operated independently. The outer end of the bolts connects with an elongated slot of a position bar with this position bar being spaced slightly and being separate from the grab bar. By operating of the bolts, the position bar can be located in a skewed position relative to the grab bar or can be located substantially parallel to the grab bar. The bolts can be operated to lock in position the container connector within one opening of one shipping container with the opposite end of the grab bar being in central alignment to be conducted within the opening of its aligned corner block of the shipping container to which the first shipping container is to be attached. When the second shipping container is moved in its desired closely spaced position in conjunction of the first container, the appropriate threaded bolts are operated in a manner to tightly secure in position the container connectors so that the shipping containers are tightly locked together in a positive relationship. The entire load of the connection is handled by the grab bar and not by the position bar. In order to facilitate adjustability of the position bar relative to the grab bar during the installing procedure, the position bar is longitudinally movable relative to the grab bar within the limits of the length of the elongated slot formed within the position bar.

The primary objective of the present invention is to construct a container connector which positively secures together a substantially abutting pair of shipping containers and secures such together in a positively locked relationship so that the pair of containers can be handled as a single large size container.

Another objective of the present invention is to construct a container connector which permits one end of the connector to be installed in place and secured in that position thereby eliminating the need for any individual's hand to hold the container connector in place as the second container is moved in conjunction with the container connector.

Another objective of the present invention is to construct a container connector which can be centrally aligned with the opening of the corner block of the second container after it has been installed in conjunction with the first container so as to facilitate its connection with the second container.

Another objective of the present invention is to construct a container connector which is composed of few parts and therefore can be manufactured at a reasonable price and therefore purchased by the consumer at a reasonable price.

Another objective of the present invention is to design a container connector which can be operated in a simple manner and therefore operated by relatively unskilled individuals.

DETAILED DESCRIPTION OF THE SHOWN EMBODIMENT

Figure 1:
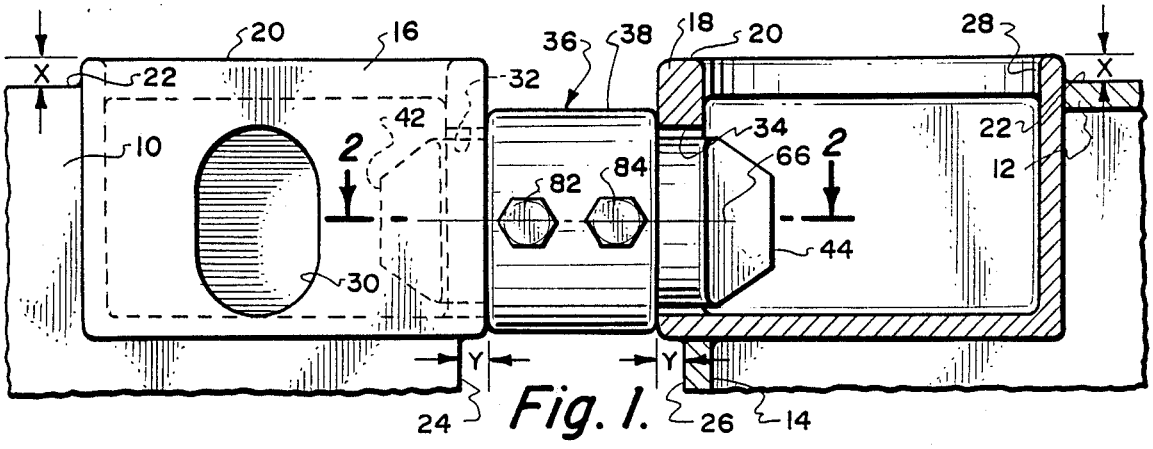
FIG. 1 is a side elevational view, partly in cross-section, showing the container connector of the present invention utilized to connect between a pair of aligned corner blocks of a pair of shipping containers.

Referring particularly to the drawings, there is shown a box-like first container 10 and a box-like second container 12. The containers 10 and 12 are hollow and include interior compartments such as interior compartment 14 for container 12. It is within these interior compartments, such as compartment 14, that product (not shown) is to be stored for shipment.

Mounted within each corner of each container 10 and 12 are corner blocks such as corner block 16 for container 10 and corner block 18 for container 12. Corner blocks 16 and 18 are identical and are mounted so that the upper edge 20 of each of the blocks 16 and 18 protrude a distance "x" above the top surface 22 of the containers 10 and 12. It is to be understood that the containers 10 and 12 are to be located in a close relationship but slightly spaced from each other with the top surfaces 22 in alignment. The vertical height of the containers 10 and 12 is to always be identical as is also the vertical width. The only dimension that varies of the containers 10 and 12 is the length. Containers 10 and 12 could be of the same length or could be of a slightly different length. In any event, it is to be understood that containers 10 and 12 are some length less than the typical twenty foot length of such containers. A common length for the containers 10 and 12 would be approximately ten feet or approximately five feet.

The reason that the top edge 20 of the corner blocks 16 and 18 protrude the distance "x" above the top surface 22 is so that, upon another container (not shown) being stacked on containers 10 and 12, the weight of this container will be supported solely on the corner blocks 16 and 18. The corner blocks 16 and 18 are to be supported by the side walls of the containers 10 and 12 and the side walls of the containers 10 and 12 may also include strengthening members (not shown) which directly connect to the corner blocks 16 and 18. If the containers 10 and 12 are caused to move longitudinally into one another, the force of such movement is to be again taken directly by the corner blocks 16 and 18 since these corner blocks 16 and 18 protrude a slight distance "y" from their respective side walls such as side wall 24 for container 10 and side wall 26 for container 12.

Each of the corner blocks 16 and 18 include an enlarged opening 28 formed within the upper surface of the corner blocks 16 and 18. The purpose of this enlarged opening 28 is to facilitate connection with a crane (not shown) to pick up and move the containers 10 and 12. Also included within the corner blocks 16 and 18 are elongated openings 30. These openings 30 are to connect with appropriate tie-down means (not shown) when securing of the containers 10 and 12 within the hold of a ship or on a truck. It is to be noted that the openings 30 are somewhat of an elliptical configuration.

Also included within the corner blocks 16 and 18 are end openings 32 and 34 respectively. Each of the openings 32 and 34 are identical in size and are also generally of a somewhat of an elliptical configuration similar to openings 30. Openings 32 and 34 are elongated in a vertical direction and are somewhat narrowed in a horizontal direction. It is the openings 32 and 34 to which connector 36 of the present invention is to be connected.

Connector 36 is basically composed of a grab bar 38 and a position bar 40. The grab bar 38 is constructed of solid metal with generally steel being preferable. The grab bar 38 has a first pointed end 42 which is to be locatable within the corner block 16 and a second pointed end 44 which is to be locatable within the corner block 18. Grab bar 38 also has a center section within which is formed a pair of threaded holes 46 and 48. Threaded holes 46 and 48 are of the same size and each include the same type of threads. Threaded holes 46 and 48 extend from the outer surface 50 of the grab bar 38 to the inner surface within which is formed a narrow recess 52. The holes 46 and 48 are each through openings.

Figure 2:
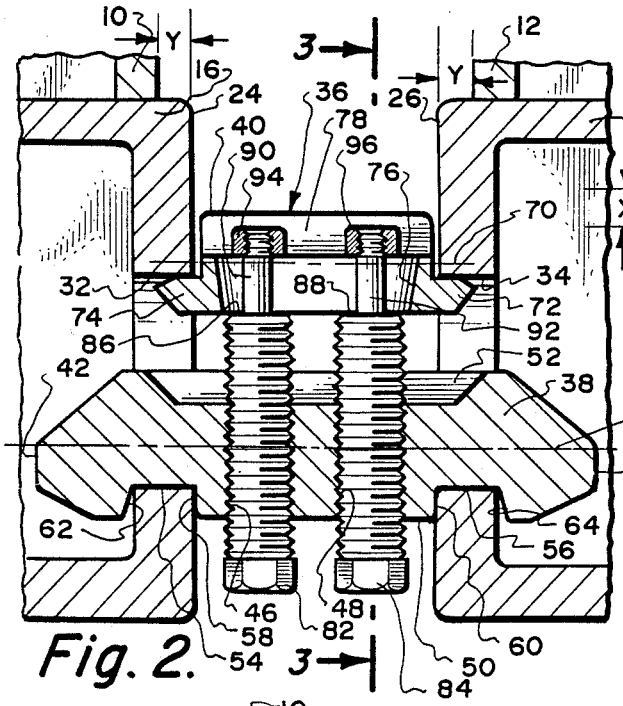
FIG. 2 is a cross-sectional view taken along line 2—2 of FIG. 1 showing the container connector in the installed position.
Figure 3:
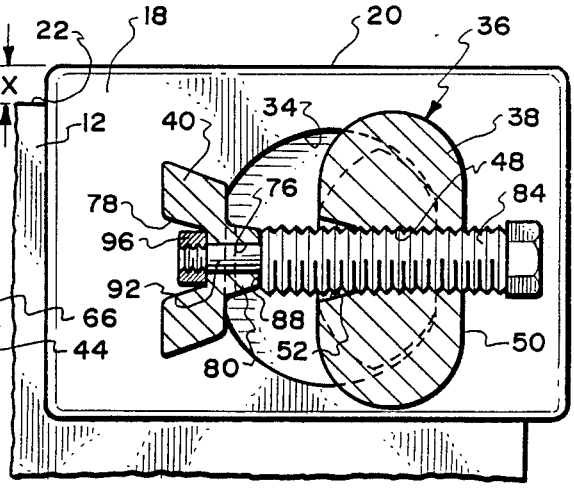
FIG. 3 is a transverse cross-sectional view through the container connector of the present invention taken along line 3—3 of FIG. 2.

Formed within the outer surface 50 are a pair of grooves 54 and 56. The grooves 54 and 56 are located spaced apart with groove 54 being located adjacent end 42 and groove 56 located adjacent end 44. Groove 54 has an inner wall 58 and groove 56 has an inner wall 60. It is to be noted that the distance between the inner walls 58 and 60 is slightly greater than the length of the main body portion of position bar 40. With the connector 36 in the installed position, as shown in FIG. 2 of the drawings, it can thus be seen that the load is taken by the grab bar 38 since the corner block 16 is flush against the inner wall 58 and the corner block 18 is flush against the inner wall 60 and the corner blocks 16 and 18 are slightly spaced from the main body section of the position bar 36. It has also to be noted that the walls 58 and 60 are vertical and parallel to the respective side walls 24 and 26.

The grooves 54 and 56 also include respective outer edges 62 and 64. As is readily apparent in the drawings, the edges 62 and 64 are inclined outwardly so that, when the grab bar 38 is installed as in FIG. 2, there is a wedge-shaped space formed between the surfaces of the edges 62 and 64 and their respective corner blocks 16 and 18. The reason for this tapering is that, during installation of the grab bar 38 as is depicted generally in FIG. 4, the grab bar 38 will be canted so the longitudinal center axis 66 of grab bar 38 is inclined relative to the installation axis 68. It is to be noted that the position bar 40 has a longitudinal center axis 70 which is located substantially parallel to the installation axis 68. The inclining of the edge 64 of the groove 66 is so as to facilitate engagement with the side wall of the hole 34 within the groove 56. The same applies also for groove 54 if that end 42 of the grab bar 38 is first installed in position within the corner block 16. It is to be understood that it is an option to install initially in position either end 42 or end 44.

The position bar 40 has a flange 72 located at one end of the position bar 40 and a flange 74 located at the opposite end of the position bar 40. The flange 72 is to abut against the wall surface of the opening 34. The flange 74 is to abut against the wall surface of the opening 32. Extending between the flanges 72 and 74 is a narrow open-ended slot 76. Slot 76 connects with a channel 78 formed within the outer surface of the position bar 40. The inner surface of the position bar 40 is formed in an elongated and narrow protuberance 80. It is to be understood that the slot 76 is formed within the protuberance 80.

Threadably connected with the hole 46 is a threaded bolt 82. An identical threaded bolt 84 connects with the hole 48. The threaded section of the bolt 82 defines an inner flange 86 with a similar inner flange 88 being defined by the threaded section of the bolt 84. These flanges 86 and 88 are adapted to come into contact with the elongated protuberance 80. Extending from the threaded section 82 is a narrowed non-threaded bolt section 90 with a similar narrowed bolt section 92 extending from the threaded section 84. The outer end of the narrowed section 90 is threaded to engage with a nut 94 and the outer end of the narrowed section 92 is also threaded to engage with a nut 96. The inner surface of the nuts 94 and 96 rest against the apex section of the channel-shaped groove 78.

Figure 4:
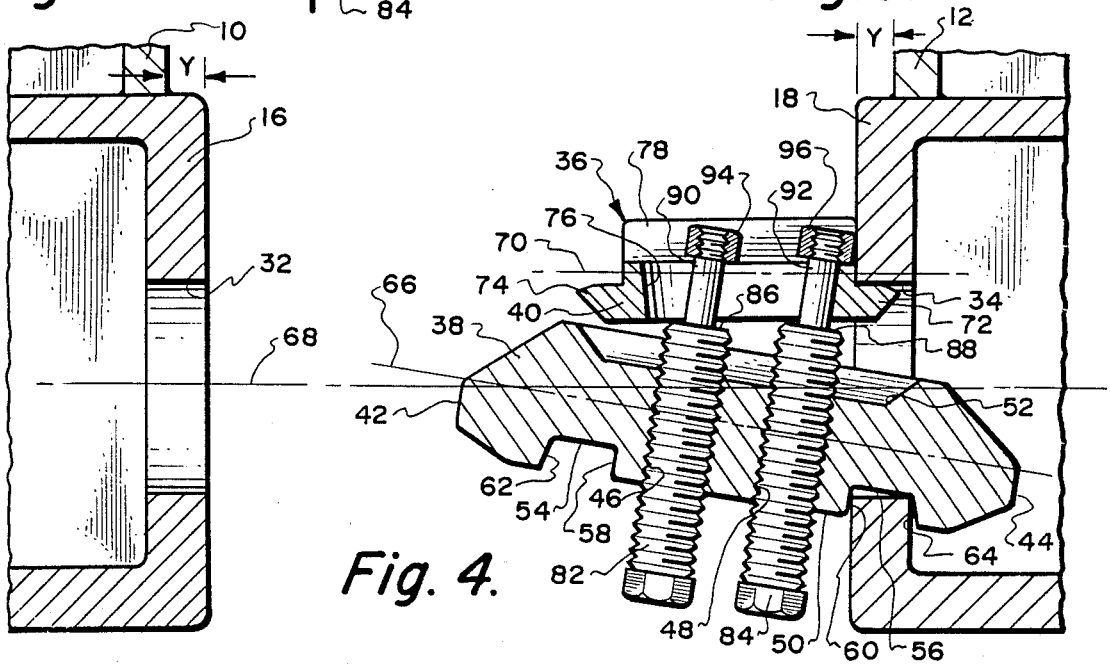
FIG. 4 is an exploded cross-sectional view, similar to that of FIG. 2, but depicting the installing procedure of the container connector.

To install the connector 36 of this invention in position, the operator loosens the threaded bolts 82 and 84 so that the grab bar 38 can be canted to a position similar to what is shown in FIG. 4 of the drawing. The operator then proceeds to place the end 44 of the grab bar 38 within the corner block 18 until the groove 56 engages with the side wall of the opening 34. At this particular time, the flange 72 is also located within the confines of the opening 34. The operator then proceeds to tighten bolt 84 pushing against the protuberance 80 until there is binding force created between the flange 72 and the groove 56 holding in position the connector 36 within the opening 34. The operator then proceeds to turn bolt 82 until the end 42 is substantially centrally positioned on the position axis 68.

It is to be understood that there will be four in number of the connectors 36 that are so installed between each directly adjacent pair of corner blocks 16 and 18. The containers 10 and 12 are then caused to be moved closer together which results in the end 42 of each connector 36 to be conducted through its respective opening 32 of each of its respective corner block 16. This movement is continued until the groove 54 is in alignment with the side wall of the hole 32. Also, the flange 74 will be located directly adjacent the side wall of the opening 32. The operator then proceeds to tighten the bolt 82 causing such to extend toward the position bar 40 which results in the grab bar 38 being pivoted so that its longitudinal center axis 66 is located parallel to the installation axis 68. At this particular time, the axis 66 is also located parallel to the axis 70. The bolts 82 and 84 are then both tightened securely with the result that a positive locking position is obtained between the grab bar 38 and the corner blocks 16 and 18.

When it is desired to separate the shipping containers 10 and 12, it is to be understood that the bolts 82 and 84 are to be loosened so as to permit the grab bar 38 and the position bar 40 to be moved closer together and the binding action relative to the side walls of the openings 32 and 34 is removed.

What is claimed is:

1. A container connector comprising:

a grab bar, said grab bar having a first end and a second end, said first end being substantially identical to said second end, a first longitudinal center axis extending between said first end and said second end, said first end including first retaining means said second end including second retaining means, said first retaining means comprising a first groove formed within the body of said grab bar, said second retaining means comprising a second groove formed within the body of said grab bar, both said first groove and said second groove having an outer wall and an inner wall, each said inner wall being in a plane substantially perpendicular to said first longitudinal center axis, each said outer wall being inclined relative to said first longitudinal center axis, the spacing between said inner walls being slightly greater than the length of said enlarged center section of said position bar, said first retaining means adapted to connect with a first shipping container, said second retaining means adapted to connect with a second shipping container;

a position bar mounted in spaced relationship from but in juxtaposition to said grab bar, said position bar having a second longitudinal center axis, said position bar having an enlarged center section terminating at each longitudinal end in a protruding flange, one said flange to engage with the first shipping container and the other said flange to engage with the second shipping container; and interconnection means connecting said grab bar and said enlarged center section of said position bar, said interconnection means being adjustable to vary the position of said grab bar relative to said position bar, said first longitudinal center axis being parallel to said second longitudinal center axis when said container connector is installed in its operating position, during installing of said container connector said first longitudinal center axis is located skewed to said second longitudinal center axis.

2. The container connector as defined in claim 1 wherein:

said position bar including an elongated slot, said interconnection means connecting with said elongated slot, whereby said elongated slot permitting adjustment of said position bar relative to said grab bar in a direction parallel to said first longitudinal center axis.

3. The container connector as defined in claim 2 wherein:

said interconnection means comprising two in number of individually operated interconnection members.

4. The container connector as defined in claim 3 wherein:

each of said individually operated interconnection members comprises a threaded bolt, said threaded bolt being threadably engaged with said grab bar.

5. A container connector comprising:

a grab bar, said garb bar having a first end and a second end, a first longitudinal center axis extending between said first end and said second end, said first end including first retaining means, said second end including second retaining means, said first retaining means adapted to connect with a first shipping container, said second retaining means adapted to connect with a second shipping container;

a position bar mounted in spaced relationship from but in juxtaposition to said grab bar, said position bar having a second longitudinal center axis, said position bar having an enlarged center section terminating at each longitudinal end in a protruding flange, said enlarged center section having an elongated slot, one said flange to engage with the first shipping container and the other said flange to engage with the second shipping container; and interconnection means comprising two in number of individually operated interconnection members connecting said grab bar and said elongated slot of said position bar, each of said individually operated interconnection members being adjustable to vary the position of said grab bar relative to said position bar, said elongated slot permitting adjustment of said position bar relative to said grab bar in a direction parallel to said first longitudinal center axis, said first longitudinal center axis being parallel to said second longitudinal center axis when said container connector is installed in its operating position, during installing of said container connector said first longitudinal center axis is located skewed to said second longitudinal center axis.

6. The container connector as defined in claim 5 wherein:

each of said individually operated interconnection members comprises a threaded bolt, said threaded bolt being threadably engaged with said grab bar.

* * * * *